US007089608B2

(12) United States Patent
Erb

(10) Patent No.: US 7,089,608 B2
(45) Date of Patent: Aug. 15, 2006

(54) SPA SYSTEM FOR TARGETED PERSONAL HYDROTHERAPY

(76) Inventor: Charles Gilbert Erb, 1333 Bayville St., Norfolk, VA (US) 23503

( * ) Notice: Subject to any disclaimer, the term of this patent is extended or adjusted under 35 U.S.C. 154(b) by 0 days.

(21) Appl. No.: 11/085,976

(22) Filed: Mar. 22, 2005

(65) Prior Publication Data

US 2005/0210575 A1 Sep. 29, 2005

Related U.S. Application Data

(60) Provisional application No. 60/556,270, filed on Mar. 25, 2004.

(51) Int. Cl.
*A47K 3/00* (2006.01)
*A47K 3/10* (2006.01)

(52) U.S. Cl. ..... 4/541.1; 4/541.4; 4/541.6

(58) Field of Classification Search ..... 4/541.1–541.6
See application file for complete search history.

(56) References Cited

U.S. PATENT DOCUMENTS 5,333,324 A * 8/1994 Pinciaro ..... 4/567
6,360,380 B1 * 3/2002 Swart et al. ..... 4/541.1
6,499,153 B1 * 12/2002 Simoni et al. ..... 4/541.1

* cited by examiner

*Primary Examiner*—Justine R. Yu
*Assistant Examiner*—Huyen Le
(74) *Attorney, Agent, or Firm*—David J. Bolduc

(57) ABSTRACT

A spa comprised of a fluid enclosure having a floor and an upstanding sidewall includes a therapy station within the enclosure. The therapy station includes an upright seat to accommodate a single person and includes a plurality of fluid jets in the footwell and sidewall of the enclosure at various targeted hydrotherapy locations. Pressurized water is provided to the hydrotherapy locations by a pair of fluid pumps. Each jet at the hydrotherapy locations is provided with a variable flow controller adapted to control the water flow out of the jet. Each hydrotherapy location is also provided with a variable flow controller adapted to control the flow of air into the jet. Each hydrotherapy location is also provided with a directional flow controller. Each jet discharges water flow at one horsepower or more to provide intense hydrotherapy selectably directed to multiple portions of the body simultaneously or individually.

14 Claims, 5 Drawing Sheets

SPA SYSTEM FOR TARGETED PERSONAL HYDROTHERAPY

This application claims the benefit of priority under 35 U.S.C. 119(e) from U.S. Provisional Application 60/556,270 filed on Mar. 25, 2004.

BACKGROUND OF THE INVENTION

1. Field of the Invention

The present invention relates generally to hydrotherapy systems and devices. More specifically, the present invention relates to a hydrotherapy spa designed for a single person. The spa preferably has a comparatively smaller profile than conventional spas and includes a seat within a tub enclosure. The hydrotherapy spa has a plurality of water/air jets that are fed from a very high horse-power system of one or more centrifugal pumps. The spa also includes a system for individually controlling the jets, including the number of jets, the air water mixture and the horsepower of the water fed to each jet for targeted hydrotherapy. The spa combines the advantages of hot water therapy with muscle and joint manipulation for an intense massaging and kneading effect.

2. Description of the Prior Art

For centuries man has known of the healing powers of warm water. Before the modern portable spa, people have enjoyed the relief of pain and tension offered by natural hot springs. Today, bathing appliances in the nature of spas or hot tubs have become commercially successful. Today's spa technology can offer specific therapeutic benefits known as hydrotherapy to improve physical and mental well being.

For example, painful or inflamed joints from arthritis can cause muscles to tense in an effort to protect them. Warm water and hydrotherapy help relax the muscles and allow greater range of motion in the joints. Pain is often reduced, even after leaving the spa. Also, when exercising, microscopic-tears in the muscle and lactic acid build up. The warm massaging action of a spa will accelerate the healing process, and allows the lactic acid to be carried away from the muscles. Furthermore, when submerged in water the body is about 1/10 its normal weight. Buoyancy is a key element of relaxation and stress relief. It helps overcome the effects of gravity and relieves stress on the joints. Additionally, warm swirling water reduces stress and allows people to rest and get a better nights sleep. Experts recommend that people who suffer from sleeplessness soak in a spa at 100 to 104 degrees F. for 15 minutes before bedtime.

Most important in hydrotherapy is pain relief. The release of endorphins, which are natural painkillers for the body is stimulated by warm water. When the body is in warm water, blood vessels near the skin relax, allowing more blood to flow, bringing endorphins and nutrients to damaged cells. Treating the neck with hydrotherapy is useful for vertigo, mild depression, hypersensitivity to weather changes, tenseness in shoulder and neck, headaches and migraines. Hydrotherapy for the chest is useful for angina pectoris, bronchial asthma and bronchitis. Water therapy for the upper trunk (upper torso and arms) is useful for improving blood flow to the heart, lungs and pleura. It is useful for stimulating respiratory and cardiac activity, toning up, varicose veins, nervous excitability, headaches, disease of larynx and vocal cords, bronchial asthma and bronchitis. This method of hydrotherapy should not be used if there is blood stasis in the pulmonary circulation. Using hydrotherapy on the arms is useful for cold hands, catarrh in the nose and throat, headaches, vertigo, heart problems, rheumatism of the arms, neuralgia, paralysis and nervous disorders. Treating the hips with hydrotherapy is useful ailments affecting the abdomen, reproductive system, inflammations, pelvic congestion, cramps, hemorrhoids, kidney pain and intestinal pain. It is also useful for treatment of enlargement of the gall bladder and stone formation, enlargement of the liver, and diabetes mellitus. It should not be used for sciatica, irritable bladder, urinary tract infections or during menstruation. Hydrotherapy for the thighs can help improve poor circulation and stimulate blood flow. It is useful in the treatment of arthritis, paralysis, muscular rheumatism and varicose veins. Water therapy for the thighs should also not be used for sciatica, irritable bladder, urinary tract infections or during menstruation. Treating the toes (i.e., reflexology), feet and legs with hydrotherapy is useful for headaches and migraines, varicose veins, contusions, sleeplessness and low blood pressure. This type of water therapy can help ward off vascular damage and influence the digestive and reproductive organs. Like the hips and thighs, hydrotherapy for the toes, feet and legs should not be used for sciatica, irritable bladder, urinary tract infections or during menstruation.

Typical bathing appliances in the nature of spas or hot tubs spas are constructed as a molded shell to form a water containment or fluid enclosure having a footwell or floor and an upstanding sidewall. Molded within the enclosure are a plurality of therapy stations which may include seats or platforms for reclining. The shell is typically constructed of fiberglass, plastic or a similar material, or a composite of such materials. One or more pumps are usually placed under the shell to draw water from the enclosure and discharge it, usually with air, into the enclosure through a plurality of nozzles or jets of various types. The jets are usually mounted through the shell in either or both of the floor and sidewall. Typically, jets mounted through the sidewall are located below the water line of the spa, and in any event, the jets are designed to provide a comforting or therapeutic effect to a person occupying a therapy station. Water lines or piping are provided between the various jets, pumps and water inlet ports, and are usually comprised of polyvinylchloride ("PVC") piping and flexible tubing. Various filters, heaters, cleaning units and diverter valves may also be provided in the typical spa.

Conventional hot tubs or spas generally have three or four main therapy stations or seats, typically a lounge seat and a pair of corner seats, or four corner seats. They may also have one or more side stations or seats. All of these stations are usually provided with a number of jets through which warm water is forced to provide the hydrotherapy effects. These spas circulate and pump the water through the jets using one or two pumps, which are typically located on one side of the spa for convenient access. Consequently, the system requires piping of significant length, diameter and complexity, and usually a number of diverter valves. Because of the significant lengths of piping between the pumps and the jets, significant frictional losses are encountered. In order to compensate for these frictional losses, conventional spas are usually provided with large pumps and motors. The typical spa of conventional design will have-one or two pumps of 4–6 HP, each of which has an output capacity at the pump of 230 gallons/minute. When one or more of these pumps of a conventional spa is operated, water is forced through jets at more than one station or seat, even if only one seat is occupied. This provides approximately 2–3 HP or 100 gallons per minute per station in the typical 4-seat tub, and only 8–16 gallons per minute per jet or approximately 0.2–0.3 HP per jet.

In recognition of some of these problems, spas have been developed that employ unitary hydrotherapy jet and pump assemblies, in which a pump is provided for each jet. Such assemblies are described in U.S. Pat. No. 4,853,987 of Jaworski, U.S. Pat. No. 5,056,168 to Mersmann and U.S. Pat. No. 5,742,954 to Idland. Such assemblies are typically limited to spas having several jets at a plurality of therapy stations.

U.S. Pat. No. 6,000,073 to Eddington describes a system for adjusting the distribution of water flow between two supply pumps and the various therapy stations of a spa. A water supply line that is in fluid communication with all the jets is also connected to the pump outlets of the two pumps. Diverter valves are placed in the. supply line on opposite sides of each therapy station or at other locations between the therapy stations. By setting one of the diverter valves to the "closed" position, the flow will be blocked between one therapy station and the adjacent one. This will serve to divide the jets between the two pumps, so that one or more therapy stations are supplied by one pump and the remainder by the other pump.

U.S. Pat. No. 6,681,414 to May et al discloses a therapeutic spa having a number of jets at multiple therapy stations and having a separate control system for each therapy station. Each hydrotherapy assembly includes a separate fluid pump and a variable flow controller, which controller is adapted to control the flow of fluid from the discharge port of the pump through the jets into the enclosure.

Although the Eddington system represents an improvement over the typical conventional system described above, it still requires piping of significant length, diameter and complexity, which leads to significant frictional losses. Such a system would still require large pumps and motors in order to compensate for these frictional losses.

Consequently, most spa systems require piping of significant length, diameter and complexity, and usually a number of diverter valves. Because of the significant lengths of piping between the pumps and the jets, significant frictional losses are encountered. In order to compensate for these frictional losses, conventional spas are usually provided with large pumps and motors. Furthermore, a typical spa of conventional design will have two 6 HP pumps which provide minimal horsepower and gallons per minute to the various therapy stations and jets.

Thus, the prior art devices identified above suffer a host of disadvantages. None of the devices above provide for a hydrotherapy device that provides significant power to a single hydrotherapy station. Furthermore, none of the above devices provides a single hydrotherapy station that provides significant power to a jet or group of jets to provide targeted hydrotherapy to part of the body in need of more attention. The above mentioned devices, even where therapy can be targeted to a single station or a single group of jets, still provide only a small amount of horsepower and gallons per minute to these controlled jets.

Accordingly, it is an object of the present invention to provide a new and useful targeted hydrotherapy spa.

Another object of the present invention is to provide a targeted hydrotherapy spa that has a small footprint compared to prior art hydrotherapy systems.

Another object of the present invention is to provide a targeted hydrotherapy spa that is lightweight and compact compared to prior art hydrotherapy systems.

Another object of the present invention is to provide a targeted hydrotherapy spa that is adapted to serve a single person seated upright in the spa.

Another object of the present invention is to provide a targeted hydrotherapy spa that is adapted to provide very high horsepower and flow at a plurality of jets to a single person in the spa.

Another object of the present invention is to provide a targeted hydrotherapy spa that is adapted to provide control of the flow rate to each of the jets in the spa.

Another object of the present invention is to provide a targeted hydrotherapy spa that is adapted to provide control of the air induction into the water at each jet in the spa.

Another object of the present invention is to provide a targeted hydrotherapy spa that is adapted to provide a high amount of flow and horsepower, in excess of one horsepower, to each jet in the spa.

The foregoing and other objects of the present invention, as well as the invention itself, may be more fully understood from the following description when read in conjunction with the accompanying drawings.

SUMMARY OF THE INVENTION

The invention is a targeted hydrotherapy spa comprising a fluid enclosure having a floor and an upstanding sidewall, and a single, upright seated therapy station within the enclosure. A plurality of fluid jets in the sidewall and footwell of the enclosure is provided. The targeted hydrotherapy spa also includes a fluid pump having a suction port that is in fluid communication with the inlet and a discharge port that is in fluid communication with the jets. The pump is adapted to move fluid from the enclosure through the fluid inlet and suction port and back through the discharge port and the jets into the enclosure. A variable flow controller is also provided at each jet, which controller is adapted to control the flow of fluid through the jets into the enclosure. Each jet also has a non-electrical switch used to control the amount of air introduced into the water at each jet.

An advantage of the invention is that by employing a single person spa, that the spa has a lower profile, smaller footprint and lower weight as compared to multi-person spas.

Another advantage of the invention is that by providing a pair of motors for the targeted hydrotherapy spa for a single person that more horsepower and flow is provided to individual jets for more intense hydrotherapy.

Another advantage of the invention is that by providing individual air and flow controls to the jets of the targeted hydrotherapy spa, that more horsepower and flow is controlled at individual jets for more intense and targeted hydrotherapy.

Still another advantage of the invention is that by providing for a single person hydrotherapy spa, smaller and shorter fluid lines to the jets may be employed, thereby minimizing frictional losses.

Additional objects and advantages of this invention will become apparent from an examination of the drawings and the ensuing description.

In order to facilitate an understanding of the invention, the preferred embodiments of the invention are illustrated in the drawings, and a detailed description thereof follows. It is not intended, however, that the invention be limited to the particular embodiments described or to use in connection with the apparatus illustrated herein. Various modifications and alternative embodiments such as would ordinarily occur to one skilled in the art to which the invention relates are also contemplated and included within the scope of the invention described and claimed herein.

BRIEF DESCRIPTION OF THE DRAWINGS

The presently preferred embodiments of the invention are illustrated in the accompanying drawings, in which like reference numerals represent like parts throughout, and in which.

DESCRIPTION OF THE PREFERRED EMBODIMENTS

Figure 1:
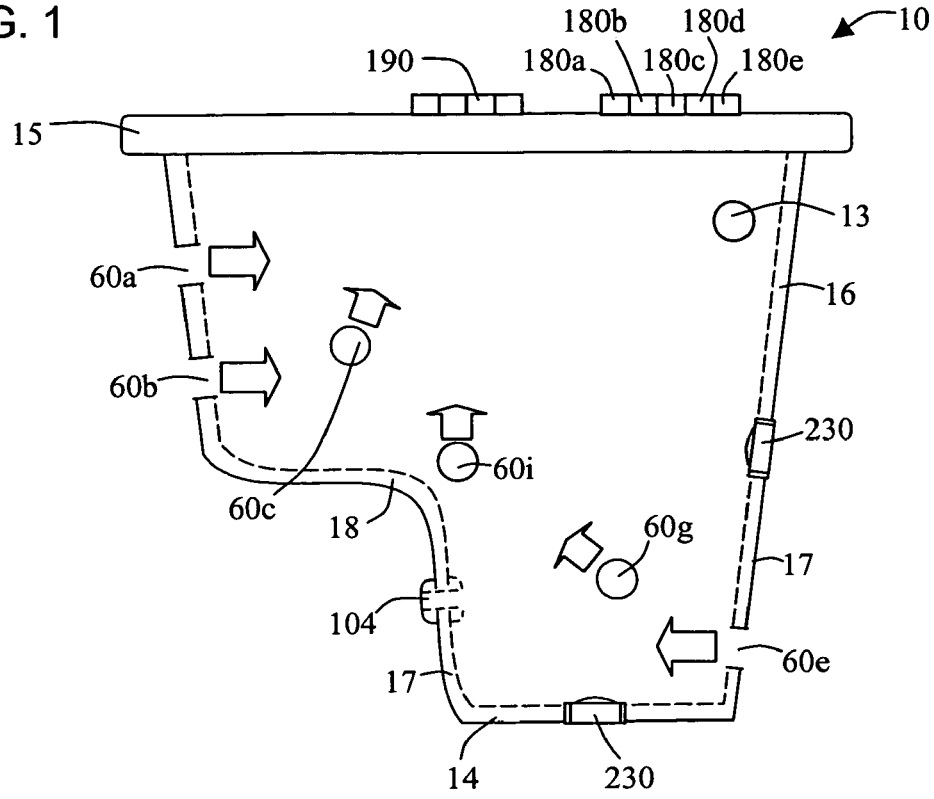
FIG. 1 is a left side elevation of the single person targeted hydrotherapy spa of the invention.
Figure 2:
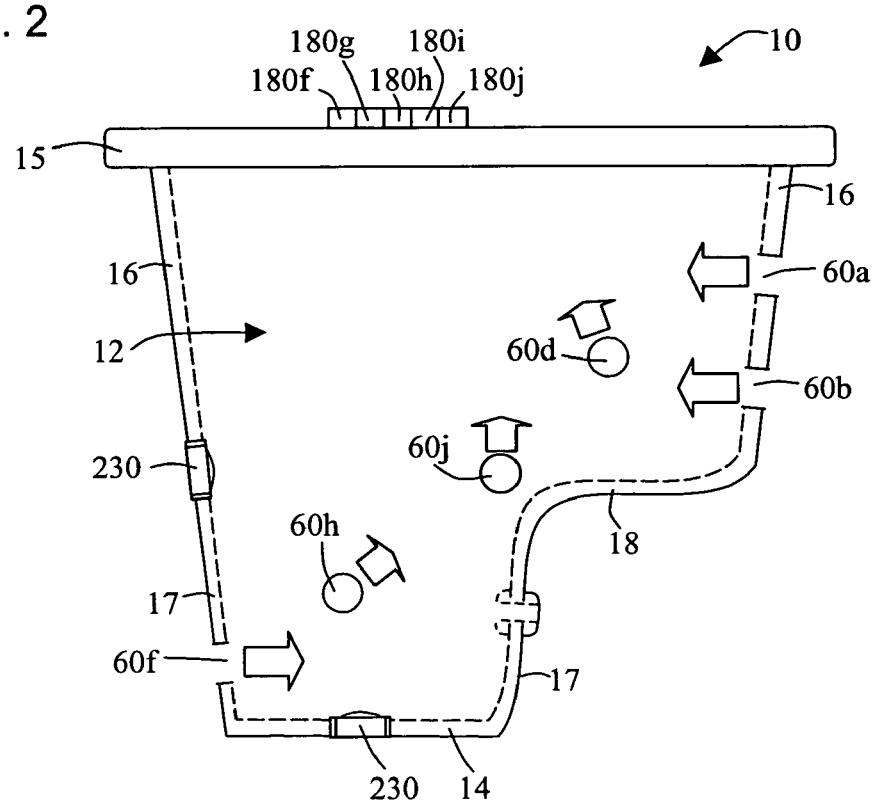
FIG. 2 is a right side elevation of the single person targeted hydrotherapy spa of the invention.
Figure 3:
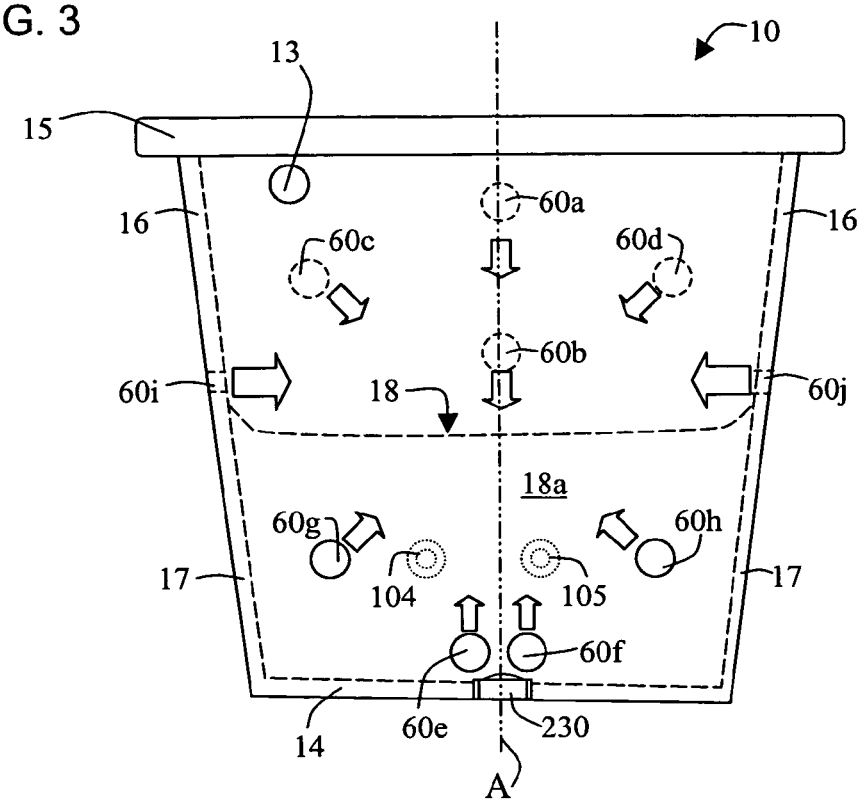
FIG. 3 is a front elevation of the single person targeted hydrotherapy spa of the invention.
Figure 4:
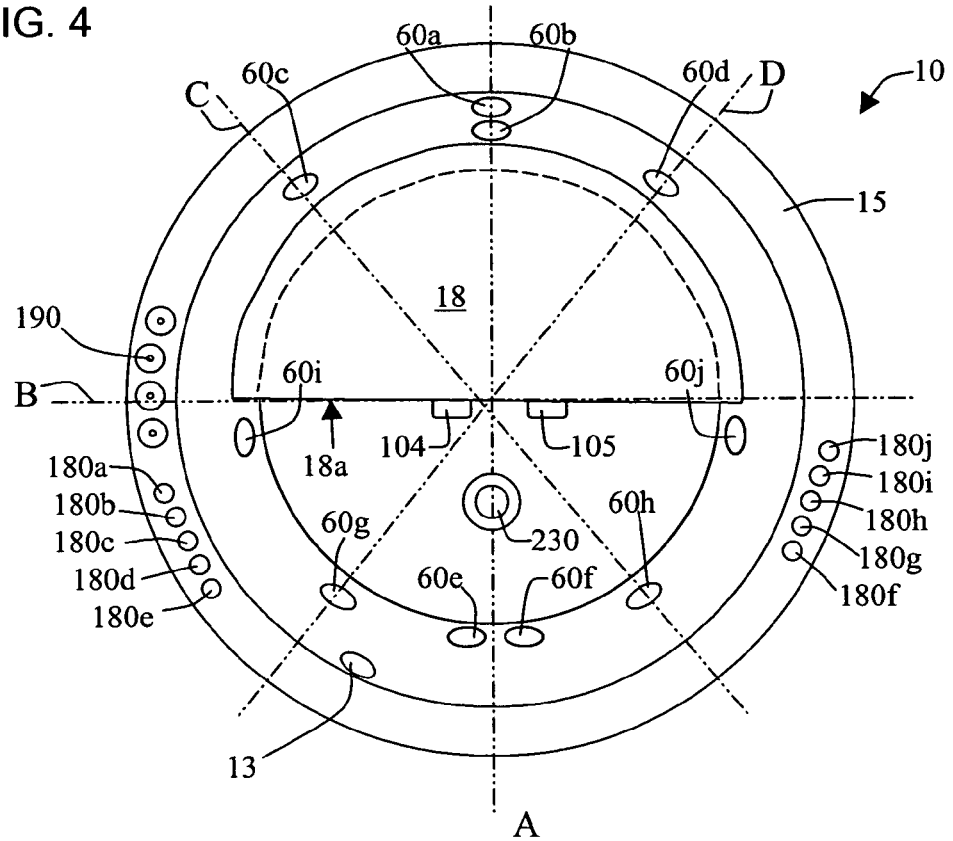
FIG. 4 is a plan view of the single person targeted hydrotherapy spa of FIGS. 1–3.

As used herein, the term "spa" or hot tub refers to a bathing appliance that is adapted to contain a fluid such as water and which includes one or more therapy stations that may be occupied by a person, each of which stations include one or more jets. As used herein, the term "jet" or "fluid jet" refers to an orifice or nozzle through which a fluid such as water may be pumped, discharged of dispensed into the fluid enclosure of a spa for therapeutic effect. Jets may be provided in various shapes and sizes to produce various therapeutic effects.

Referring now to FIGS. 1–4: The figures illustrate the preferred spa 10, which comprises a fluid enclosure 12 having a floor 14 and an upstanding sidewall 16. The floor 14 is located at the bottom of and is surrounded by upstanding footwell wall 17. The tub is formed generally in the shape of a truncated cone, wherein the floor 14 has a smaller diameter with the sidewall 16 tapering outwardly toward the top portion of the sidewall 16 and having a substantially horizontal seat 18 between the footwell 17 and the sidewall 16. Exemplary tub dimensions include a floor 14 having an inside diameter of approximately 2 feet six inches with sidewall 16 tapering outward to a diameter of approximately 3 feet at a tub height of approximately 4 feet 3 inches. However, the tub dimensions may vary between 2–3 feet at the bottom, 2.5–4 feet at the top and 3.5–5 feet in depth.

The tapered shape of the spa 10 allows the tub to conform generally to the human body and allows the tub to be easily removed from an enclosure for the tub 10. The enclosure shell of preferred spa 10 is constructed of conventional materials such as plastic, vinyl and/or fiberglass and gel coated for comfort and attractiveness. The seat 18 and floor 14 are preferably reinforced, for example using a rigid wooden, metal and or plastic frame. The tub 10 having such dimensions holds approximately 200–300 gallons of water.

The spa 10 includes one therapy station, designated generally as hydrotherapy station 100 which includes a substantially horizontal seat 18 located approximately half way between the floor 14 and the top portion of the sidewall 16. The seat 18 is essentially semicircular as viewed from above and extends into the spa 10 approximately half-way between the sidewalls 16, and more preferably 40–50 percent the distance between opposing sidewalls 16. The seat 18 may be contoured to accommodate the buttocks and thighs of a person seated thereon, and may also have a rounded shape at its juncture with the vertical sidewalls 16 and the footwell wall 17. The seat 18 is approximately 3 feet wide and 1.5 feet deep in order to accommodate people of various sizes, and also to allow a person seated therein to rotate or position their body according to the type of directed hydrotherapy that is preferred. A non-floating cushion (not shown) may also be provided for shorter persons or to elevate a person in the seat 18 to position their body according to the type of directed hydrotherapy that is preferred.

Figure 5:
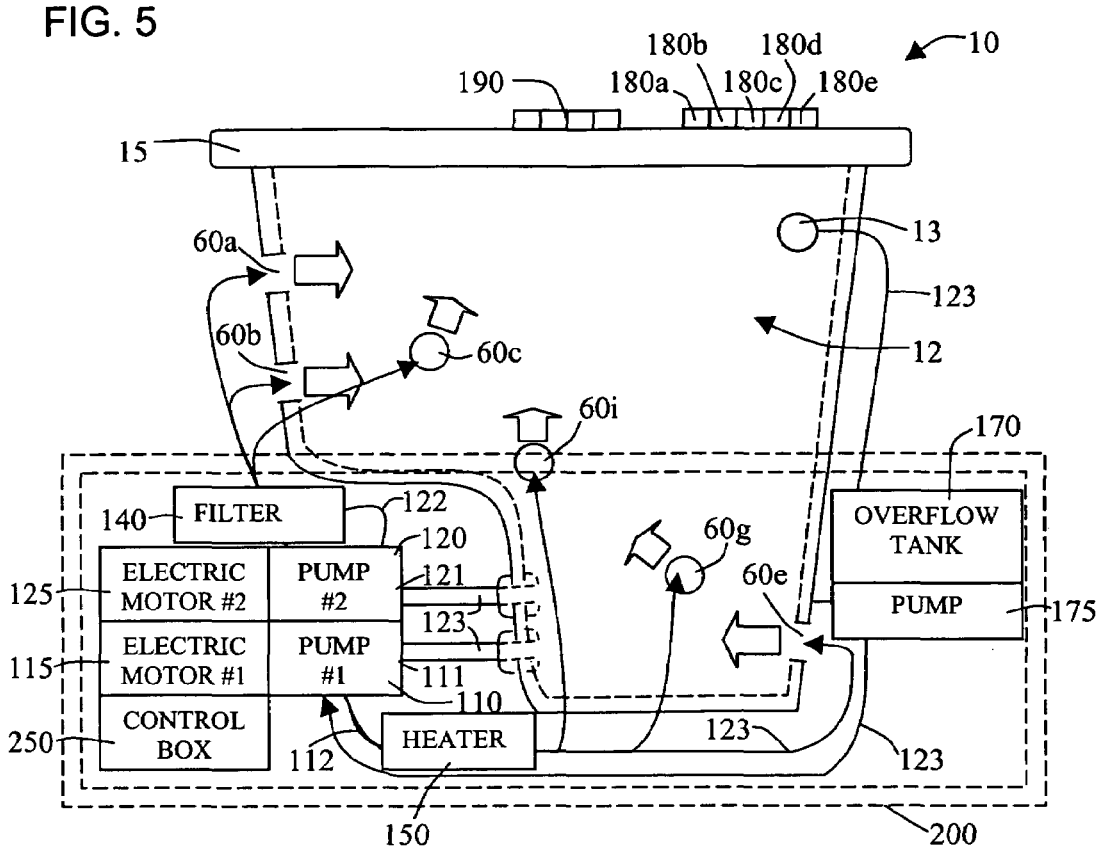
FIG. 5 is a partial schematic right side elevation showing the flow of water between the spa, pumps, water piping and jets.
Figure 6:
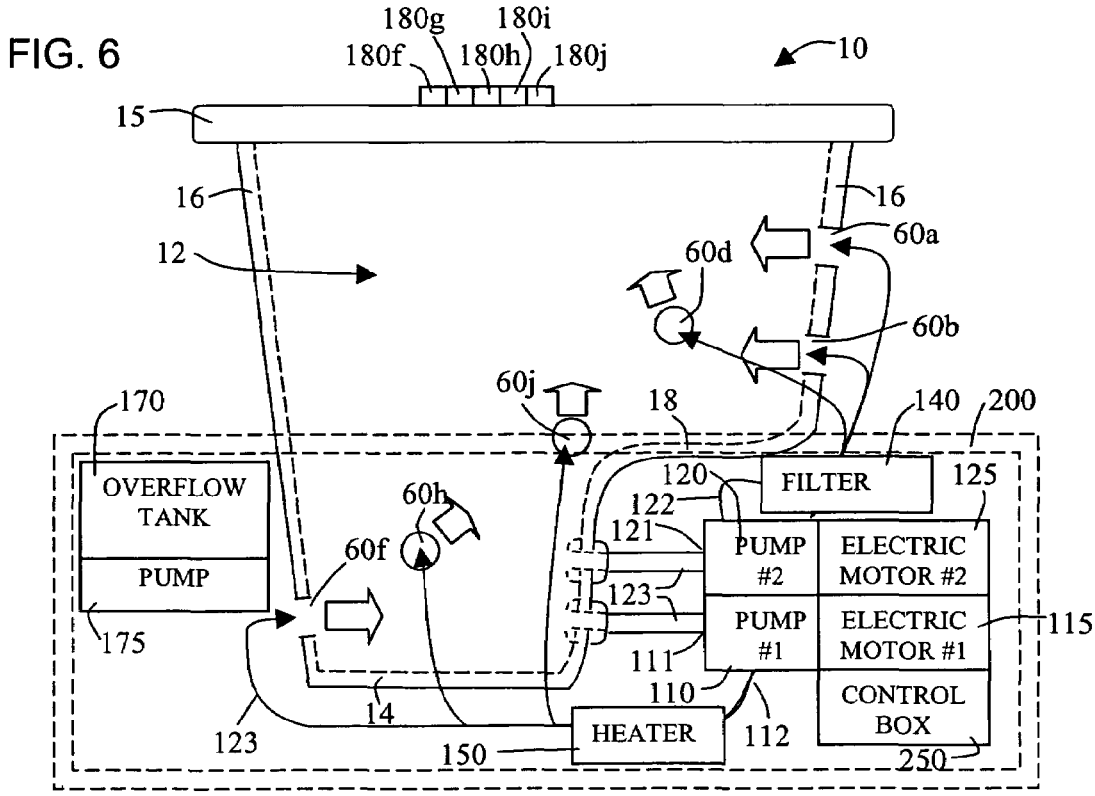
FIG. 6 is partial schematic left side elevation showing the flow of water between the spa, pumps, water piping and jets.

At the top portion of the sidewall 16 is a substantially circular mounting ring 15, having a greater diameter (approximately 2–6 inches greater) than the top portion of the sidewall 16 to which it is rigidly attached. The mounting ring 15 is preferably reinforced, for example using a rigid wooden, metal and or plastic frame The mounting ring 15 facilitates placement of the spa 10 within an enclosure (not shown) such as a decorative or structural wooden frame in a deck or other spa enclosure that extends up to the mounting ring 15. The tapered shape of the spa 10 also allows for ease of placement and removal of the tub 10 from the enclosure while the retaining ring 15 provides strength and rigidity to the tub 10 while maintaining the tub 10 position relative to the enclosure. FIGS. 5–6 show an enclosure 200 that extends approximately half way up the sidewall 16 of the tub 10 and which contains various air, fluid and electrical components of the spa 10 further described herein below.

The spa 10 includes a plurality of fluid jets 50 which are mounted in and through the sidewall 16 and footwell wall 17 of the enclosure. The jets 50 can be of any convenient size and type, but most preferably comprise one or more venturi nozzles 50 having a diameter of 1–2 inches and most preferably approximately 1.5 inches. Each of these jets 50 extends through the spa walls 16, 17 at a plurality of hydrotherapy jet locations 60 in order to deliver aerated fluid flow to specific portions of a body seated upright in the seat portion 18 of the hydrotherapy spa 10. Each of the jets 50 is capable of delivering aerated or unaerated water, and each jet 50 is controllable in the flow rate and directional flow.

Figure 7:
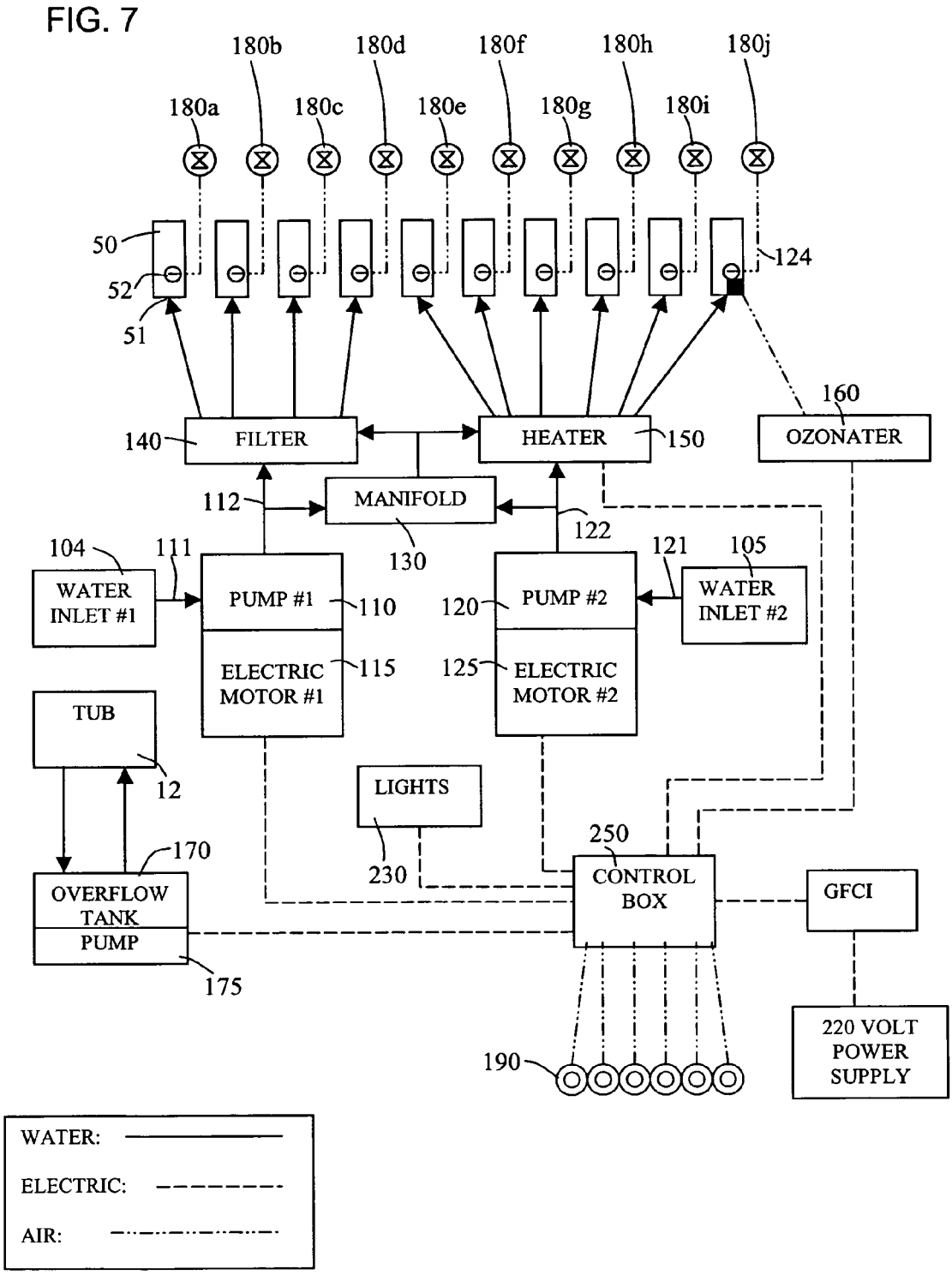
FIG. 7 is partial schematic elevation showing the flow of air, water and electricity between the spa components including the control box, pumps, heater, filter, ozonater, water piping and jets, electrical controls and air controls.
Figure 8:
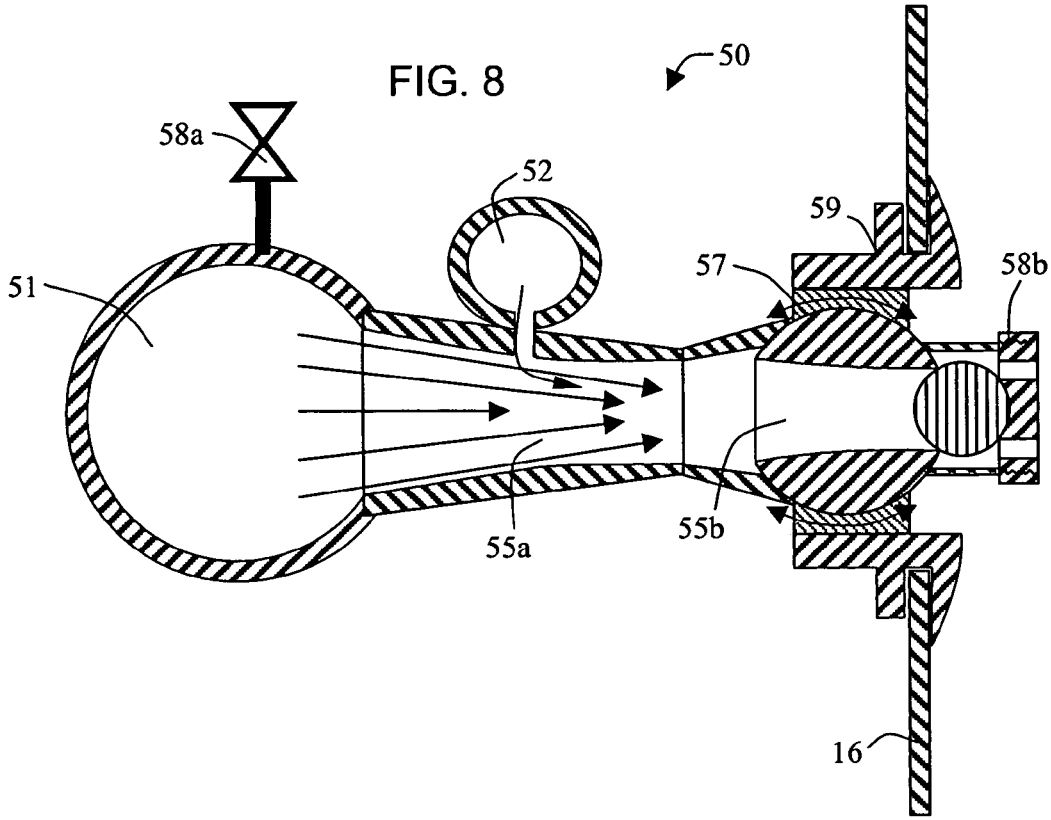
FIG. 8 is a cross-sectional elevation showing the air and water flow through an exemplary jet in the current invention with the flow controller in the fully open position.

Referring to FIGS. 7–8: At least one of the jets 50 has an ozone generator ("ozonator") 160 connected thereto. The ozonator 160 is an electrical device that produces ozone and introduces it into the air inlet 52 (as in FIG. 7) of one of the jets 50 to provide fresh air into the water in the tub 10.

Referring again to FIGS. 1–4: The tub 10 has a plurality of upper body hydrotherapy locations 60*a*–*d* extending through the sidewall 16 around the periphery above the seat 18. A first pair of hydrotherapy locations 60*a*, 60*b* are located in the sidewall 16 centered along an axis A above and bisecting the seat 18 so that the first hydrotherapy location 60*a* impinges on the neck, upper back and/or shoulders, and the second hydrotherapy locations 60*b* impinges on the lower back and/or hips/buttocks.

A second pair of hydrotherapy locations 60*c*, 60*d* are located in the sidewall 16 above the seat 18, and along axes C, D bisecting the seat central axis A and the seat front edge axis B. Right side upper hydrotherapy location 60*c* is located along or in proximity to axis C between the seat and the retaining ring 15 and impinges on the right arm, bicep, tricep and/or shoulders, and left side hydrotherapy location 60*d* is located along axis D between the seat and the retaining ring 15 and impinges on the left arm, bicep, tricep and/or shoulders.

The tub 10 also has a plurality of lower body hydrotherapy locations 60*e–j* extending through the sidewall 16 around the periphery above the footwell 17. A first pair of lower body hydrotherapy locations 60*e*, 60*f* are located in the sidewall 16 in the lower part of the footwell 17 adjacent the floor 14 on both sides of axis A opposite the seat 18 so that the first lower body hydrotherapy location 60*e* impinges on the right toes, foot and ankle, and the second lower body hydrotherapy location 60*f* impinges on the left toes, foot and ankle.

A second pair of lower body hydrotherapy locations 60*g*, 60*h* are located in the sidewall 16 opposite the seat 18, and along axes C, D and halfway between the floor 14 and the seat 18. The first right side lower body hydrotherapy location 60*g* is located along or in proximity to axis D between the seat 18 and the floor 14 and impinges on the right calf, shin or lower knee, and first left side lower body hydrotherapy location 60*h* is located along or in proximity to axis C between the seat 18 and the floor 14 and impinges on the left calf, shin or lower knee.

Finally, a third pair of lower body hydrotherapy locations 60, 60*j* are each located in the sidewall 16 in proximity to the seat 18 front edge axis B. The second right side lower body hydrotherapy location 60*i* is located along or in proximity to axis B adjacent to the right side of the seat 18 front edge 18*a* and impinges on the right hip, buttocks, thigh and/or upper knee, and second left side lower body hydrotherapy location 60*j* is located along or in proximity to axis B adjacent to the left side of the seat 18 front edge 18*a* and impinges on the left hip, buttocks, thigh and/or upper knee.

The tub 10 also has least one and preferably two fluid inlets, such as unfiltered fluid inlets 104, 105 which are of sufficient diameter to provide adequate return to the spa pump(s). The fluid inlets 104, 105 can be of any convenient size, such as 3–4 inch diameter, and can be located in any convenient location. Preferably the fluid inlets 104, 105 are located below the seat 18 in the footwell adjacent each side of axis A. Fluid inlets 104, 105 extend through the footwell wall 17 and below the seat portion 18 to at least one and preferably two fluid pumps 110, 120 located outside the fluid enclosure 12 below the seat 18.

Each pump 110, 120 preferably comprises an electric motor driven pump, 110, 120 that is rated between 6 and 12 HP, and most preferably rated between 7 and 8 horsepower. Each of the fluid pumps 110, 120 has a suction port 111, 121 and a discharge port 112, 122 respectively. The first fluid pump 110 has a suction port 111 connected to one fluid inlet 104 with conventional piping 123, such as PVC piping and the second fluid pump 120 also has a suction port 121 connected to the other fluid inlet 105 with conventional piping 123, such as PVC piping. Each of the pumps 110, 120 is driven by an electric motor 115, 125 rated at 240 volts and having an electrical on/off control.

Each of the fluid pumps 110, 120 also has a discharge port 112, 122 connected to the jets 50 at the hydrotherapy jet locations 60*a–j*. Preferably the discharge port 112 of the first pump 110 is connected to the jets 50 at each of the lower body hydrotherapy locations 60*e–j* and the discharge port 122 of the second pump 120 is connected to the jets 50 at each of the upper body hydrotherapy locations 60*a–d*. Preferably the pumps 110, 120 are connected to the jets 50 with both rigid and flexible PVC piping 123, for example approximately 2 inch diameter piping 123, which tapers to approximately 1.5 inch diameter at the water inlet of each spa jet 50. Alternately, the pump discharge ports 112, 122 may be connected to a common manifold 130 for further routing to the jets 50 at the hydrotherapy locations 60*a–j*. Furthermore, the discharge port 112 of the first pump 110 may have a filter 140 connected between the discharge 112 (and manifold 130) and the jets 50. Furthermore, the discharge port 122 of the second pump 120 may have a heater 150 connected between the discharge 122 (and manifold 130) and the jets 50. Alternately, the heater 150 may be downstream of the first discharge port 112 and the filter may be downstream of the second discharge port 122. Further alternatively, the heater 150 and filter 140 may be downstream of the manifold 130 which manifold has an inlet connected to both discharge ports 112, 122. The filter 140 may comprise for example a Dynamic Series Model RDC 255 filter having a 25 square foot filtering surface and a working pressure of 80 psi. The heater 150 may comprise for example an electric water heater rated at 240 volts and 5.5 kilowatts, such as manufactured by RMF.

The spa 10 also includes an overflow port 13 in the sidewall 16 of the tub 10 in proximity to the upper portion of the sidewall 16 adjacent the mounting ring 15. The overflow port has piping 123 that diverts the overflowing water to the suction port 111, 121 of one or both pumps 110, 120. The spa 10 may also comprise an overflow tank 170 and/or an overflow pump 175 to help divert the fluid to the pumps 110, 120, pump suctions 11, 121 or most preferably directly back into the fluid enclosure 12. The overflow tank 170 comprises a small fluid enclosure suitable for temporarily retaining a certain amount of overflow, e.g., 25 gallons. The overflow pump 175 is preferably a small pump 175 having 1/32–1/2 horsepower, and preferably 1/5 horsepower for diverting the fluid in the overflow tank 170 to fluid inlets 104 or 105 and/or to the pump suction ports 111, 121, or directly to the fluid enclosure 12. The overflow pump 175 may be remotely activated, or may include a power switch in proximity to the pump 175 or tank 170, and may further comprise a power switch activated and deactivated by a float valve within the tank 170.

The spa 10 also includes one or more lights 230 for lighting the interior of the fluid enclosure 12. Preferably the light(s) 230 is mounted through the floor 14 and/or sidewall 16 of the tub 10, and is electrically connected to a control box 250 described further herein below.

Referring to FIG. 8: Each of the hydrotherapy locations 60*a–j* has an adjustable jet 50 connected via various piping 123 to the discharge port(s) of the pumps 110, 120 and also to piping or tubing 124 for directing air into the water stream through each jet 50. As the person sits in the seat 18 their anatomy is massaged by an aerated or non-aerated water stream flowing out of one or more of the hydrotherapy spa jets 50. The jet 50 provides this stream of water by directing the water stream through a nozzle 40, into the body of water, and against the portion of the patient's anatomy where the massaging action is desired. A high water stream speed is necessary for aerating the water stream. The water stream may be aerated by opening aeration valves 180 to admit ambient air into the water stream at the venturi section of a nozzle 55 within the jet 50.

Each jet 50 is mounted at a hydrotherapy location 60*a–j*, and has a valve body 59 that allows the jet 50 to be mounted through the sidewall 16 or footwell wall 17, and securely against the interior and exterior surfaces of the sidewall 16 and footwell walls 17. This mounting of the valve body 59 is typically accomplished with threaded fasteners and most preferably using interior and exterior flanges having threaded mating surfaces to mount compressively around the interior and exterior walls 16, 17 at each hydrotherapy location 60*a–j*.

Referring again to FIG. 8: There are many types of suitable jets 50. Each jet 50 comprises at least a water inlet 51, at least one venturi type nozzle 55, and an air inlet 52 located at the venturi section of the nozzle 55, and a jet discharge 54. Water is provided to the water inlet 51 via piping 123 (preferably both rigid and flexible PVC pipes) connected to the discharge ports 112, 122 of the pumps 110, 120. An airline 124 comprising ½ inch–1 inch plastic tubing is used for supplying air to the air inlet 52 to the jets 50 for aeration of the water as it accelerates the venturi section of the nozzle 55. Air is typically drawn from the air inlet 52 into the nozzle 55 through the venturi effect of the water accelerated through the nozzle (which venturi effect creates suction on the air inlet 52). Preferably ambient air is drawn through the airline 124 and air inlet 52 into the nozzle 55.

Various types of jets 50 may be used in the present invention. One form of hydrotherapy spa jet 50 includes a first nozzle 55*a* that accelerates a stream of water, feeding it into a second nozzle 55*b*. The water is accelerated and aerated in the first nozzle 55*a*, and then passes out through the second nozzle 55*b* and jet discharge 54 into a body of water. Additionally, these jets 50 may also include a first nozzle (not shown) which accelerates the water into a second nozzle 55*a* where aeration occurs and is discharged through yet a third nozzle 55*b*.

Each of the jets 50 receives essentially equal portions of the total power available from the two pumps 110, 120. If all ten jets 50 are fully open the power delivered from two 5 horsepower pumps is approximately one horsepower, which is 550 foot-pound per second of water. If one or more jets 50 are closed, the remaining energy is distributed to the open jets 50, the increasing the flow 10–50 percent at each of those jets 50.

Referring now to FIGS. 5–6 and 7–8: The amount of air provided to the air inlet 52 is preferably controllable. Control of the air for this aeration is preferably provided by manipulation of one or more aeration valves 180. The aeration valve 180 may also be a distribution valve 180 that allows selection of which jets 50 will receiver air. Preferably each jet 50 has a separate aeration valve 180, all of which valves are located on the mounting ring 15 in proximity to the seat 18 for ease of access to a person seated therein.

As shown in the figures, a plurality of aeration valves 180*a–j* are provided to the air inlet 52 of each of the jets 50 at each of the respective hydrotherapy locations 60*a–j*. Each of the aeration valves 180*a–j* has a fully open position allowing ambient air to flow through the valve 180*a–j*, airline 124 and air inlet 52 to allow air to be introduced into its respective nozzle 55 by the venturi effect. Each of the aeration valves 180*a–j* also has a fully closed position wherein no air is allowed into the nozzle 55. Each of the aeration valves 180*a–j* also has a variety of positions between fully opened and fully closed to allow for control of how much air is introduced into the water stream at each hydrotherapy location 60*a–j*. Thus control is provided for the air injection to provide air for stronger streams at one or more hydrotherapy locations 60*a–j*, and for less or no air at other hydrotherapy locations 60*a–j* for less intense water streams.

Aeration within the venturi of the nozzle 55 creates a water stream with enough penetration to create a massaging or kneading action. Aeration produces a stream of water that is particularly penetrating in that the velocity of the aerated water stream is higher than the velocity of the non-aerated water stream. By introducing a stream of ambient air into the venturi of the nozzles 55 and increase in energy is obtained. Considering that the kinetic energy of the water stream is proportional to its mass times the square of its velocity, when air is introduced into the stream, the overall mass of decreases, but its velocity through the nozzle is increased. The overall kinetic energy of the aerated water stream may be increased by approximately 30 percent by the introduction of air into the water stream.

Figure 8A:
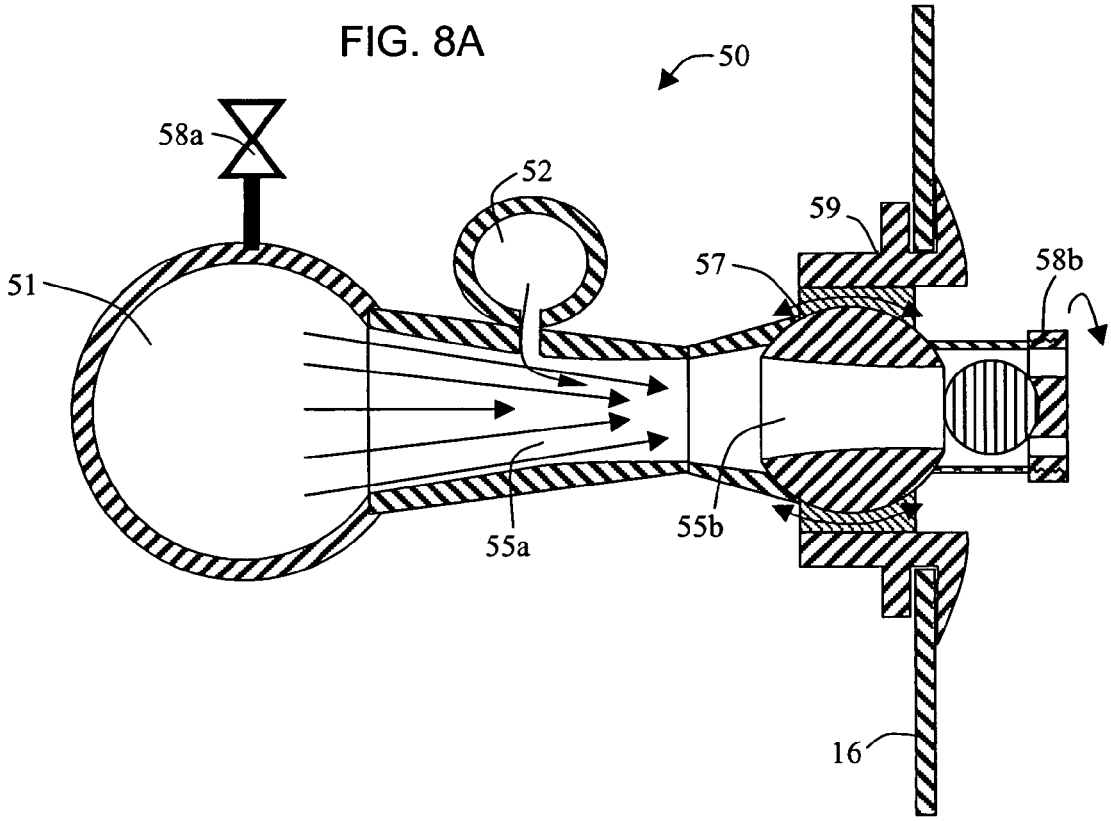
FIG. 8A is a cross-sectional view of the flow controller of FIG. 8 in a rotated, partially closed position.

Referring again to FIGS. 8 and 8A: Once the aeration valve 180 is opened to a water jet 50, aeration of the water jet can be further varied by adjusting the water flow at each jet 50. Water flow to each jet 50 has been controlled at a central distribution valve, but more commonly at each individual jet 50 itself. The strength of the water stream at the outlet 54 of the jet 50, i.e., just before entering the fluid enclosure 12, may be adjusted with a flow valve 58. The flow valve 58 is typically threaded valve 58 attached to the jet body 59, which when rotated either allows full flow through the valve 58, or restricts the flow through the valve 58. The valve 58 is preferably an inlet flow valve 58*a* connected to the water inlet 51 to control the flow of water into the nozzle 55. This may be accomplished in any number of valve 58*a* configurations such as a gate valve, ball valve, globe valve, or a butterfly valve. Alternately, the flow valve 58 may be an outlet flow control valve 58*b* connected at the outlet of the nozzle 55, such as the threaded ball and seat valve 58*b* shown in FIGS. 8–8A, in the closed and open positions respectively. This outlet flow valve 58*b* may be accomplished in any number of valve configurations such as a gate valve, ball valve, globe valve, or a butterfly valve, or a valve that rotates the relative alignment of multiple orifices. When the valve 58*a* and/or 58*b* is fully open, the maximum amount of water flows through the nozzle(s) 55 creating a greater venturi effect to introduce the maximum amount of air (as may be limited by the aeration valve) into the water stream for the maximum flow at that valve. Throttling down the valve 58*a* and/or 58*b* (as by rotating the valve) limits the water flow, concomitantly decreasing the venturi effect and amount of air introduced into the water stream.

Referring again to FIG. 8: Directional control is preferably incorporated into hydrotherapy spa jets 50. A nozzle, i.e., second nozzle 55*b*, with a spherical exterior can be mounted in a socket 57 in the valve body 59 with a conforming spherical interior to produce a directional nozzle 55 that may be rotated in an eyeball-like fashion. Such nozzles 55 deflect the water stream, thus providing directional control for better targeting of the water stream to muscle groups for hydrotherapy.

An additional advantage of the spa is that as the flow to individual jets 50 is limited, the power to the remaining jets 50 is increased. For example, if a person wishes to have hydrotherapy targeted to their neck and back, the person in the spa 10 may close the flow control valves 58 for the jets 50 at the bicep hydrotherapy locations 60*c*, 60*d*. This increases the available power pumped to the remaining jets 60*a* and 60*b*, thereby providing more intense hydrotherapy. Likewise the positions of the air valves 180 may be controlled to provide aerated (and concomitantly higher velocity) hydrotherapy to the jets 50 having their respective air valves 180 fully opened.

Referring again to FIGS. 5–7: The spa 10 also includes pneumatically operated main control switches 190 mounted on the retaining ring 15. The control switches 190 are preferably air activated switches 190, which when pressed send a pneumatic signal to an electrical control box 250 for the spa 10 electrical components. Using air switches 190 eliminates the hazard of electrical shock when activating the spa 10 electrical components.

The control box 250 preferably comprises a New-Wave Control Supreme series box 250 with temperature control, GFCI, circuit breaker, timer, indicator lights and timer selector. The control box 250 also includes controls for the power supply to the pumps 110, 120, water heater 150, light(s) 230, and ozonator 210. Additional switches 190 may be provided for child safety controls (not shown) and controls for the overflow pump 175. The control box 250 is connected to a 220 volt power supply and may have an additional Ground Fault Circuit Interrupter Circuit between the power supply and the control box 250. Each of the air switches 190 is capable of electrically energizing electrical components connected to the control box 250, namely, the lights 230, pumps 110, 120, heater 150, ozonater 160, and the overflow pump 170.

Although this description contains many specifics, these should not be construed as limiting the scope of the invention but as merely providing illustrations of some of the presently preferred embodiments thereof, as well as the best mode contemplated by the inventor of carrying out the invention. The invention, as described herein, is susceptible to various modifications and adaptations, and the same are intended to be comprehended within the meaning and range of equivalents of the appended claims.

PARTS LIST

10 spa
12 fluid enclosure having a
14 floor
15 mounting ring
16 sidewall
17 footwell wall
18 seat
18*a* seat front edge
50 fluid jet
51 jet water inlet
52 jet air inlet
54 fluid jet discharge
55 venturi nozzle(s)
57 rotational socket
58 jet flow valve(s)
59 jet valve body
60 hydrotherapy jet location
60*a* neck jet location
60*b* lower back jet location
60*c* right arm jet location
60*d* left arm jet location
60*e* right foot jet location
60*f* left foot jet location
60*g* right calf jet location
60*h* left calf jet location
60*i* right hip jet location
60*j* left hip jet location
100 hydrotherapy station
104 first pump fluid inlet
105 second pump fluid inlet
110 first pump
111 first pump suction port
112 first pump discharge port
115 first pump electric motor
120 second pump
121 second pump suction port
122 second pump discharge port
123 piping
124 air tubing
125 second pump electric motor
130 manifold
140 filter
150 heater
170 overflow tank
171 overflow pump
180*a–j* aeration valves
190 pneumatic control valves
200 equipment enclosure
210 ozonator/ozone generator
230 light(s)
250 electrical control box

What is claimed is:

1. A targeted personal hydrotherapy spa comprising:

a fluid enclosure having a floor, an upstanding sidewall, a footwell and a substantially horizontal seat adjacent said sidewall and footwell;

said seat being adapted to accommodate a single person thereon in a substantially upright seated position;

said sidewall and said footwell having a plurality of targeted hydrotherapy locations therein;

said targeted hydrotherapy locations corresponding to body portions of said substantially upright seated person in said seat;

said body portions comprising a) the neck, b) the lower back, c) the right arm, d) the left arm, e) the right thigh, f) the left thigh, g) the right calf, h) the and left calf, i) the right foot and toes, j) and the left foot and toes;

a plurality of fluid jets adjacent said seat in said sidewall and said footwell;

each of said fluid jets being located in said sidewall or said footwell at each of said targeted hydrotherapy locations;

each of said fluid jets having a water inlet, an air inlet, at least one nozzle and a water discharge outlet;

each of said fluid jets being adjustable in flow rate of water at said water discharge outlet;

each of said fluid jets being adjustable in flow rate of air into said air inlet;

a fluid inlet through said sidewall or footwell of said fluid enclosure;

at least one fluid pump, each of said at least one fluid pumps having a suction port in fluid communication with said fluid inlet and a discharge port in fluid communication with said fluid jets;

said at least one pump being adapted to move fluid from said fluid enclosure through said fluid inlet and said suction port to said discharge port and through said plurality of fluid jets into said fluid enclosure with a discharge flow rate at each of said jets of at least one horsepower, a first fluid inlet through said sidewall of said enclosure and second fluid inlet through said sidewall of said enclosure; a first fluid pump having a first suction port and a first discharge port, said first suction port being in fluid communication with said enclosure through said first fluid inlet; and a second fluid pump having a second suction port and a second discharge port, said second suction port being in fluid communication with said enclosure through said second fluid inlet; said first and second fluid pumps having a discharge capacity of at least ten horsepower; wherein said first and second discharge ports are in fluid communication with each of said water inlets in said plurality of fluid nozzles.

2. The spa according to claim 1, wherein each of said fluid jets further comprises:

directional flow control means for adjusting a direction of fluid flow at said discharge outlet;

wherein said directional flow control means expands an area of said targeted hydrotherapy locations corresponding to body portions of said substantially upright seated person in said seat;

and wherein said body portions at said targeted hydrotherapy locations includes the a) the neck, upper back and shoulders b) the lower back, hips and buttocks c) the right bicep, tricep, and shoulder, d) the left bicep, tricep, and shoulder, e) the right thigh and hip, f) the left thigh and hip, g) the right knee, calf and shin, h) the left knee, calf and shin, i) the right foot, toes and ankle, j) and the left foot, toes and ankle.

3. The spa according to claim 1, further comprising:

a fluid manifold having an inlet port and a plurality of outlet ports;

said inlet port being in fluid communication with said first and second discharge ports of said first and second fluid pumps;

each of said outlet ports being in fluid communication with a respective water inlet in said plurality of fluid jets.

4. The spa according to claim 1, further comprising:

a first fluid conduit connected between said first discharge port and said water inlets of a first plurality of fluid jets in an upper body group of targeted hydrotherapy locations;

said upper body group of targeted hydrotherapy locations comprising a) the neck, b) the lower back, c) the right arm, d) the left arm;

a second fluid conduit connected between said second discharge port and said water inlets of a second plurality of fluid jets in lower body group of targeted hydrotherapy locations;

said lower body group of targeted hydrotherapy locations comprising e) the right thigh, f) the left thigh, g) the right calf, h) the and left calf, i) the right foot and toes, j) and the left foot and toes.

5. The spa according to claim 1, further comprising:

a fluid filter having a filter inlet and a filter outlet;

said filter inlet being in fluid communication with said first or second discharge port of said first or second pump;

said filter outlet being in fluid communication with at least one water inlet in said plurality of fluid jets.

6. The spa according to claim 1, further comprising:

a fluid heater having an unheated fluid inlet and a heated fluid outlet;

said unheated fluid inlet being in fluid communication with said first or second discharge port of said first or second pump;

said heated fluid outlet being in fluid communication with at least one water inlet in said plurality of fluid jets.

7. The spa according to claim 1, further comprising:

a plurality of aeration valves in proximity to said seat portion and in fluid communication with an air atmosphere; and a plurality of air lines connected between each of said aeration valves in said plurality of aeration valves and each of said air inlets in said plurality of fluid jets;

wherein each of said aeration valves has a fully open position which allows said air atmosphere to enter said air inlet of each of said at least one nozzles in said plurality of fluid jets;

and wherein each of said aeration valves has a fully closed position which allows no air to enter each of said air inlets in said at least one nozzle in said plurality of fluid jets.

8. The spa according to claim 1, wherein each of said fluid jets further comprises:

a flow controller at said water inlet or said water discharge outlet of said fluid jet for controlling an outlet water flow rate;

said flow controller having a fully open position wherein water flow is unrestricted at an outlet water flow rate of at least one horsepower;

said flow controller having a fully closed position wherein water flow is blocked;

wherein placing one or more of said flow rate controllers in said closed position increases said outlet water flow rate at said fluid jets not having a flow controller in said closed position.

9. The spa according to claim 1, further comprising:

an ozone generator in fluid communication with at least one water inlet of a fluid jet in said plurality of fluid jets.

10. A targeted personal hydrotherapy spa comprising:

a fluid enclosure having a floor, an upstanding sidewall, a footwell and a substantially horizontal seat adjacent said sidewall and footwell;

said seat being adapted to accommodate a single person thereon in a substantially upright seated position;

said sidewall and said footwell having a plurality of targeted hydrotherapy locations therein;

said targeted hydrotherapy locations corresponding to body portions of said substantially upright seated person in said seat;

said body portions comprising a) the neck, b) the lower back, c) the right arm, d) the left arm, e) the right thigh, f) the left thigh, g) the right calf, h) the and left calf, i) the right foot and toes, j) and the left foot and toes;

a plurality of fluid jets adjacent said seat in said sidewall and said footwell;

each of said fluid jets being located in said sidewall or said footwell at each of said targeted hydrotherapy locations;

each of said fluid jets having a water inlet, an air inlet, at least one nozzle and a water discharge outlet;

each of said fluid jets being adjustable in flow rate of water at said water discharge outlet;

each of said fluid jets being adjustable in flow rate of air into said air inlet;

a first fluid inlet through said sidewall of said enclosure and a second fluid inlet through said sidewall of said enclosure;

a first fluid pump having a first suction port and a first discharge port;

said first suction port being in fluid communication with said enclosure through said first fluid inlet;

said first discharge port being in fluid communication with one or more of said water inlets in said plurality of fluid jets;

a second fluid pump having a second suction port and a second discharge port;

said second suction port being in fluid communication with said enclosure through said second fluid inlet;

said second discharge port being in fluid communication with one or more of said water inlets in said plurality of fluid jets;

said first and second fluid pumps having a discharge capacity of at least ten horsepower;

a fluid filter having a filter inlet and a filter outlet;

said filter inlet being in fluid communication with said first or second discharge port of said first or second pump;

said filter outlet being in fluid communication with at least one water inlet in said plurality of fluid jets;

a fluid heater having an unheated fluid inlet and a heated fluid outlet;

said unheated fluid inlet being in fluid communication with said first or second discharge port of said first or second pump;

said heated fluid outlet being in fluid communication with at least one water inlet in said plurality of fluid jets; and an ozone generator in fluid communication with at least one water inlet in said plurality of fluid jets.

11. The spa according to claim 10, further comprising:

an electrical control box electrically connected between a power supply and spa electrical components including said first and second fluid pumps, said-heater, and said ozone generator; and a plurality of air operated switch in proximity to said seat portion and in pneumatic communication with said electrical control box;

each of said air operated switches being adapted to send a pneumatic signal to said electrical control box to energize and de-energize said spa electrical components.

12. The spa according to claim 10, further comprising:

a plurality of aeration valves in proximity to said seat portion and in fluid communication with an air atmosphere; and a plurality of air lines connected between each of said aeration valves in said plurality of aeration valves and each of said air inlets in said plurality of fluid jets;

wherein each of said aeration valves has a fully open position which allows said air atmosphere to enter said air inlet of each of said at least one nozzles in said plurality of fluid jets;

and wherein each of said aeration valves has a fully closed position which allows no air to enter each of said air inlets in said at least one nozzle in said plurality of fluid jets.

13. The spa according to claim 10, wherein each of said fluid jets further comprises:

a flow controller at said water inlet or said water discharge outlet of said fluid jet for controlling an outlet water flow rate;

said flow controller having a fully open position wherein water flow is unrestricted at an outlet water flow rate of at least one horsepower;

said flow controller having a fully closed position wherein water flow is blocked;

wherein placing one or more of said flow rate controllers in said closed position increases said outlet water flow rate at said fluid jets not having a flow controller in said closed position.

14. The spa according to claim 10, wherein each of said fluid jets further comprises:

directional flow control means for adjusting a direction of fluid flow at said water discharge outlet;

wherein said directional flow control means expands an area of said targeted hydrotherapy locations corresponding to body portions of said substantially upright seated person in said seat;

and wherein said body portions at said targeted hydrotherapy locations includes the a) the neck, upper back and shoulders b) the lower back, hips and buttocks c) the right bicep, tricep, and shoulder, d) the left bicep, tricep, and shoulder, e) the right thigh and hip, f) the left thigh and hip, g) the right knee, calf and shin, h) the left knee, calf and shin, i) the right foot, toes and ankle, j) and the left foot, toes and ankle.

* * * * *